US010220324B1

(12) United States Patent
Shoaff et al.

(10) Patent No.: US 10,220,324 B1
(45) Date of Patent: Mar. 5, 2019

(54) PLAY APPARATUS AND METHODS FEATURING MODELING COMPOUND CAN ACTUATING TOY ITEMS

(71) Applicant: Hasbro, Inc., Pawtucket, RI (US)

(72) Inventors: Matthew Shoaff, Pawtucket, RI (US); Victoria Stratford, Barrington, RI (US)

(73) Assignee: HASBRO, INC., Pawtucket, RI (US)

( * ) Notice: Subject to any disclaimer, the term of this patent is extended or adjusted under 35 U.S.C. 154(b) by 32 days.

(21) Appl. No.: 15/366,563

(22) Filed: Dec. 1, 2016

Related U.S. Application Data

(60) Provisional application No. 62/270,806, filed on Dec. 22, 2015.

(51) Int. Cl.
*A63H 3/00* (2006.01)
*A63H 33/00* (2006.01)
*A63H 3/20* (2006.01)

(52) U.S. Cl.
CPC ..... *A63H 3/005* (2013.01); *A63H 3/20* (2013.01); *A63H 33/001* (2013.01)

(58) Field of Classification Search
CPC ..... A63H 3/005; A63H 33/001; A63H 3/20
USPC ..... 446/71, 72, 73, 74, 75, 76, 77
See application file for complete search history.

(56) References Cited

U.S. PATENT DOCUMENTS 2,539,035 A 1/1951 Scanlon et al.
2,968,121 A * 1/1961 Pearson, Jr. ..... A63H 37/00 403/166
3,581,434 A * 6/1971 Fels ..... A63H 27/14 446/231
3,739,975 A * 6/1973 Davidow ..... A47G 19/2227 206/457
3,744,792 A * 7/1973 McClary ..... A63F 9/26 116/152
3,873,003 A * 3/1975 Seiferth ..... B65D 83/0027 222/105
4,164,827 A * 8/1979 Palumbo ..... A63H 33/00 40/425
4,723,932 A 2/1988 Kelley et al.
5,162,013 A * 11/1992 von Mohr ..... A63H 3/12 446/183
5,727,982 A 3/1998 Hurt
5,954,561 A * 9/1999 Cannone ..... A63H 33/3055 434/127
2004/0064983 A1* 4/2004 Joseph ..... G09F 23/00 40/324

* cited by examiner

*Primary Examiner* — Vishu K Mendiratta
(74) *Attorney, Agent, or Firm* — Perry Hoffman

(57) ABSTRACT

A toy apparatus including a figurine, a can for modeling compound mounted to the figurine and arranged as a head and face for the figurine. The figurine includes rotatable arms that are actuated by depressing the head/face can. Cans with different head and face characteristics are interchangeable with different figurine bodies, and the figurine's body includes recess molds for filling with modeling compound.

9 Claims, 13 Drawing Sheets

PLAY APPARATUS AND METHODS FEATURING MODELING COMPOUND CAN ACTUATING TOY ITEMS

CROSS-REFERENCE TO RELATED APPLICATION

This application claims priority pursuant to 35 U.S.C. 119(e) to U.S. Provisional Application No. 62/270,806, filed on Dec. 22, 2015 which is incorporated herein by reference in its entirety.

FIELD OF THE INVENTION

The present invention relates to a toy apparatus, and more particularly, to a toy apparatus including the combination of a toy item with a movable part and a container for modeling compound wherein the container is mountable to the toy item for actuating the movable part of the toy figurine, and the toy item is configured to interact with modeling compound.

BACKGROUND OF THE INVENTION

In an effort to create more play value for a toy item, the item is often combined with one or more other toy items. However, having two or three diverse toy items makes it difficult to invent a combination having good play value.

Examples of toy combinations and movable toy figurines are shown, for example, in U.S. Pat. No. 2,539,035, issue to Scanlon and Hackett in 1951 and entitled "Toothbrush Holder for Children." The combination is a penny bank and a toothbrush holder. The holder includes a tube with a closed bottom and a coil spring. Another spring includes a projection that engages the toothbrush through a hole in the handle of the toothbrush. When a coin is deposited by the child in the bank the projection may be moved away from the toothbrush hole allowing the toothbrush to be removed and used. Another U.S. Pat. No. 4,723,932 issued in 1988 to Kelley, Wittenberg and Brzezinski, related to a "Toy Doll Having Articulated Arms and a Tiltable Upper Torso." The toy doll's arms moved back and forth in response to the upper torso being tilted back and forth. Still another U.S. Patent of interest, U.S. Pat. No. 5,727,982 issued in 1998 to Hurt. The patent related to an "Action Figure With Rotating Arm Mechanism." One arm is connected by a mechanism to rotate when one of the legs of the action figure moves forward.

The invention here, described below in connection with the illustrated embodiments, offers a combination that has good play value for enhancing the original toy item. The features and advantages of the present invention will be explained in, or become apparent from, the following summary and description of the preferred embodiments considered together with the accompanying drawings.

SUMMARY OF THE INVENTION

In accordance with the present invention, an advantageous method and apparatus are provided in the form of a toy apparatus, playsets or various play pieces using a can of modeling compound in relation to another toy item where the can may function as a movable head and face for the toy item and also as an actuator to cause movement of one or more movable parts of the toy item. Multiple cans with different faces and multiple toy items with different structures are interchangeable and the cans when empty provide storage spaces. The modeling compound may also be used in molds formed on the toy item to enhance play value. The combined toy items have other advantages, namely, that the resulting toy apparatus may be easily operated, including by relatively young children. The toy apparatus is relatively simple, fun to use, safe, relatively inexpensive and yet, structurally robust.

Briefly summarized, the invention relates to a toy apparatus including a toy item, a container for modeling compound mounted to the toy item, the container being movable between a first position and a second position in relation to the toy item, and at least one movable part mounted on the toy item being movable between a first position and a second position as said container moves between the container's first position and the container's second position in relation to the toy item, wherein movement of the container from the container's first position to the container's second position by a toy user results in movement of the at least one movable part of the toy item from the movable part's first position to the movable part's second position.

The invention also relates to a method for making a toy apparatus including the steps of forming a toy item having a part movable between first and second positions, and the toy item having an upper opening, mounting a container for modeling compound in the upper opening of the toy item, the container for modeling compound being movable between first and second positions, and operatively connecting the container for modeling compound to the movable part of the toy item to enable movement of the container for modeling compound by a toy apparatus user from the container's first position to the container's second position to result in the movable part of the toy item to move from the part's first position to the part's second position.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
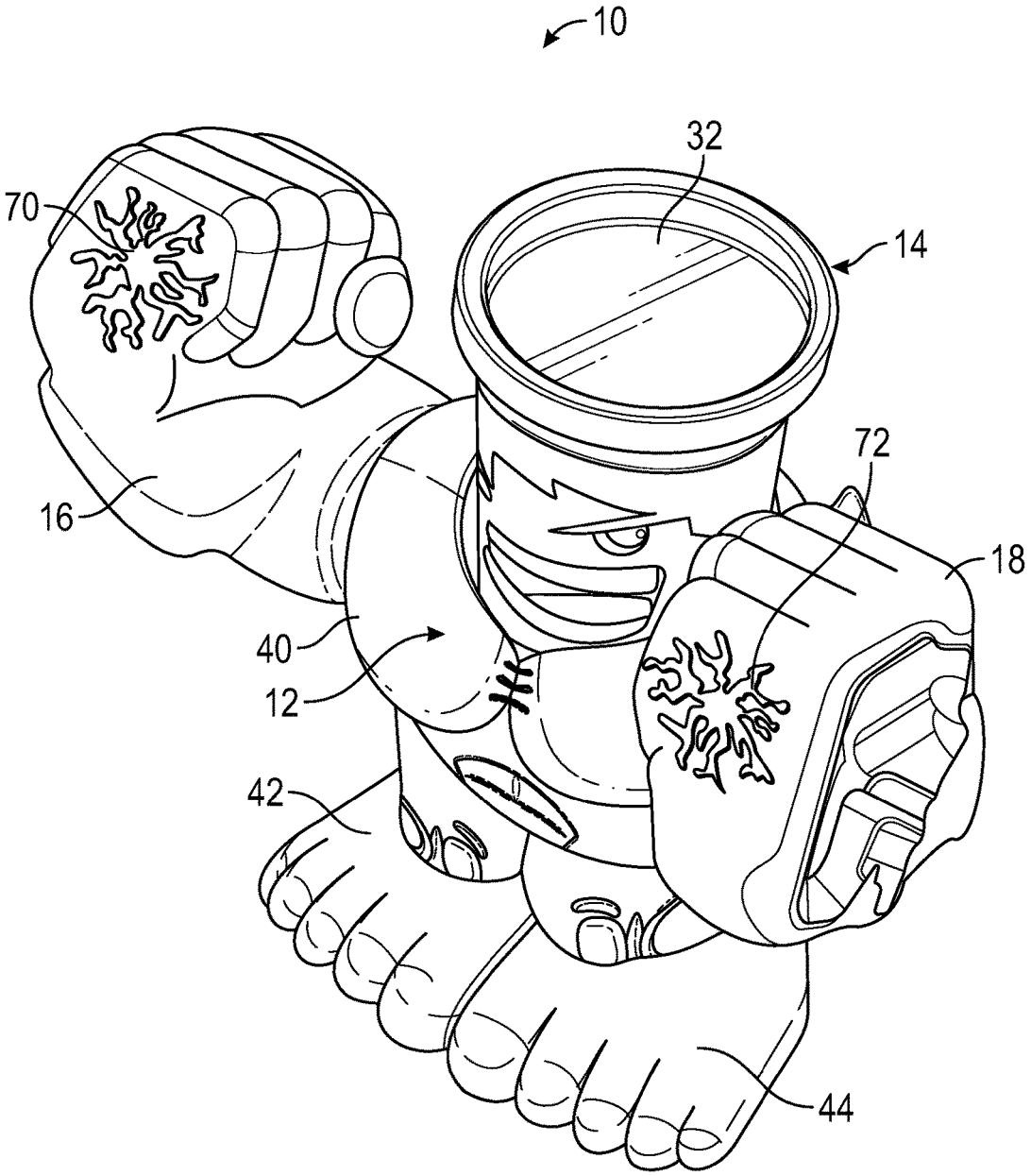
FIG. 1 is an isometric view of a preferred embodiment of the present invention in the form of a toy apparatus including a HULK® figurine with an action figure body and a mounted can for PLAY DOH® brand modeling compound where the outer surface of the can includes a label having a stylized HULK face.
Figure 2:
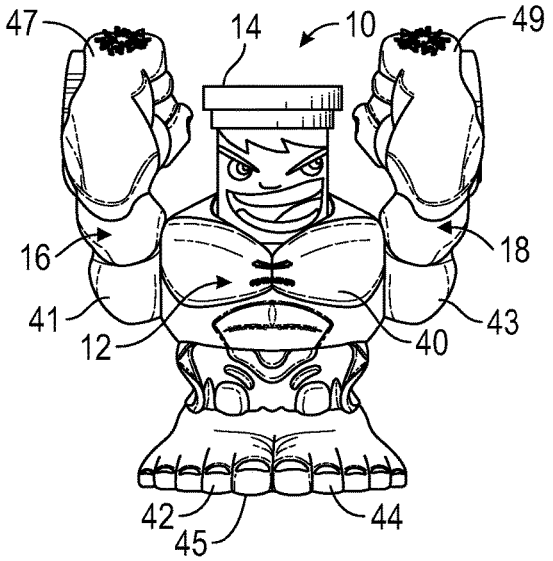
FIG. 2 is a front elevation view of the toy apparatus shown in FIG. 1, with both the figurine arms and the can in raised positions.
Figure 3:
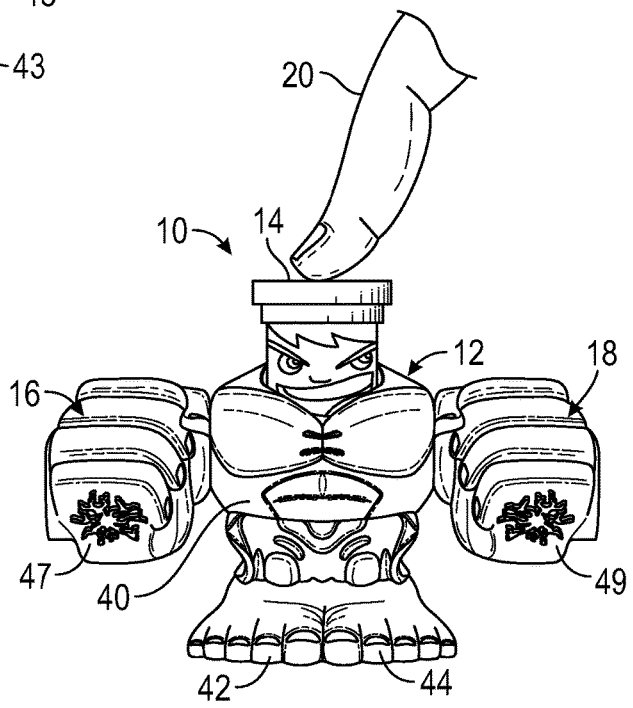
FIG. 3 is a front elevation view of the toy apparatus shown in FIGS. 1 and 2, with the can in a partially depressed position caused by a user's finger pushing on the can, and the arms are in a partially lowered position.

Referring to FIGS. 1-3, there is illustrated a toy apparatus 10 including a combination of a first toy or play item in the form of a toy figurine 12 and a second toy or play item in the form of a container or can 14 for storing modeling compound. The toy figurine 12 may take the form of a stylized fictional character, the action figure known under the brand HULK®. The second play item may take the form of a modeling compound can popularly known by the brand PLAY DOH®, and marketed by Hasbro, Inc., of Rhode Island. The HULK figurine includes two appendages in the form of elongated and heavily muscled arms 16, 18 that are movable between a first upper position shown in FIGS. 1 and 2, and a second lower position shown in FIG. 4. An intermediate position between the upper and lower positions is shown in FIG. 3.

Figure 4:
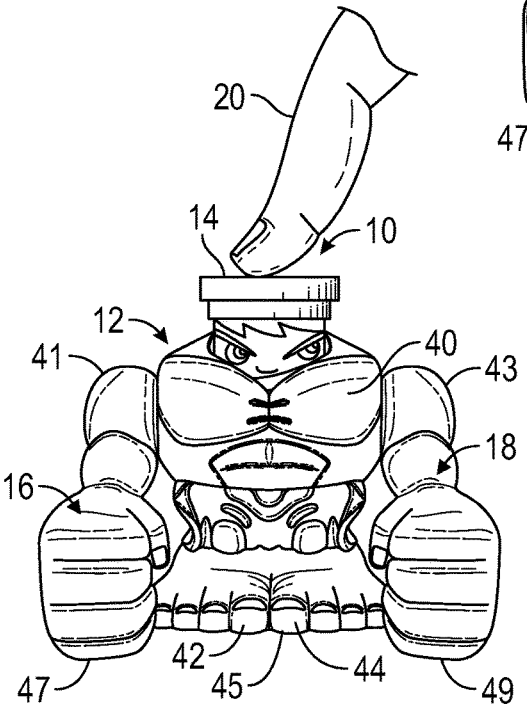
FIG. 4 is a front elevation view of the toy apparatus shown in FIGS. 1-3, with the can in a fully depressed or lowered position and the arms in a fully lowered position.

The PLAY DOH container or can 14 is operatively connected to the arms 16, 18 (as will be explained below) and is mounted to the toy figurine 12 to enable a user to depress or push downward on the can 14, as shown in FIGS. 3 and 4. Applying a force on top of the can 14 as depicted by a finger 20 in FIGS. 3 and 4, depresses the can from the upper position to the lower position. Depressing the can 14 also results in the arms 16, 18 of the figurine rotating downward from the first position shown in FIGS. 1 and 2, to the second position as shown in FIG. 4. As will be explained below, the toy figurine is configured to engage modeling compound removed from the can in addition to having the toy figurine interact with the can whether the can is empty or filled with modeling compound. For example, the can may function as a head and face for the toy figurine, and as an actuator to rotate the arms of the figurine; modeling compound may fill recesses formed in the toy figurine where the recesses act as molds; and designs on the figurine may act as stamps to emboss blobs of modeling compound. In addition, the arms may operate to grab and lift cans and blobs of modeling compound, all to enhance the play value of the can and toy item combination.

Figure 5:
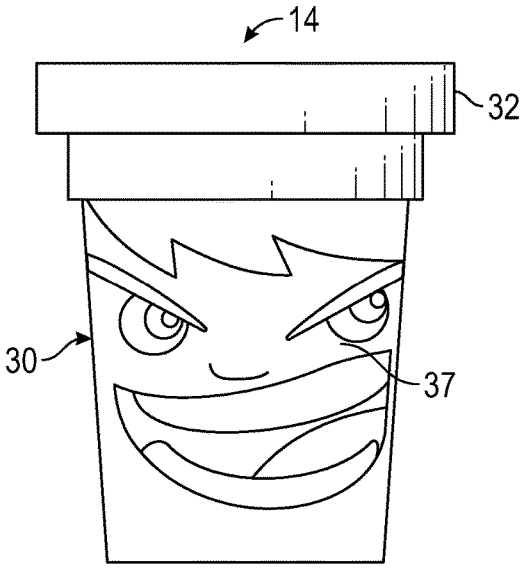
FIG. 5 is a front elevation view of the can for modeling compound shown in FIGS. 1-4.
Figure 6:
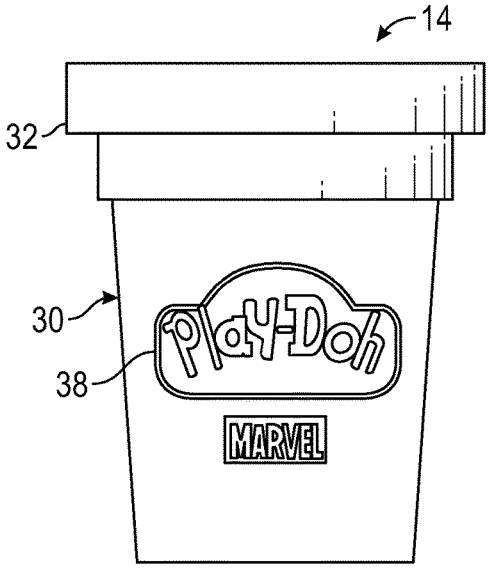
FIG. 6 is a rear elevation of the can shown in FIGS. 1-5.
Figure 7:
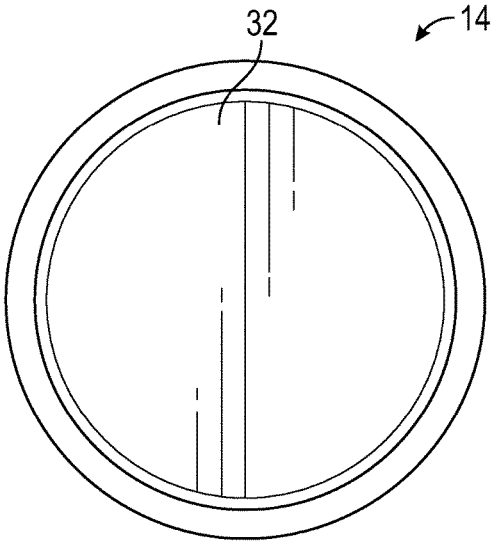
FIG. 7 is a top plan view of the can shown in FIGS. 1-6.
Figure 8:
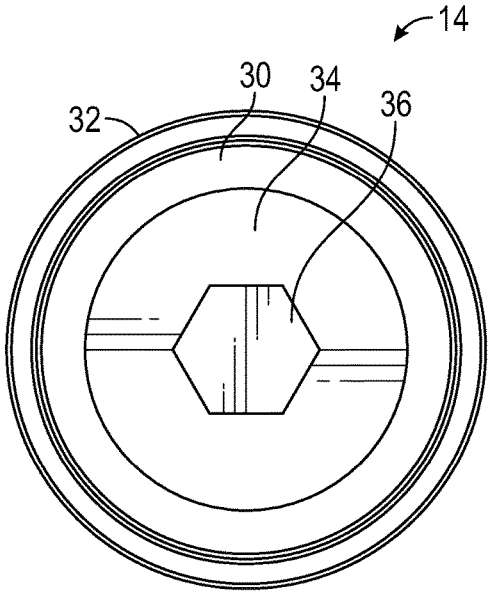
FIG. 8 is a bottom plan view of the can shown in FIGS. 1-7.

The PLAY DOH can 14 may have a generally truncated conical shape as shown in FIGS. 5 and 6, with an outer surface 30. The can also includes an open top with a top cover 32, FIGS. 1 and 5-7, and a bottom surface 34, FIG. 8 with a hexagon shaped recess 36. The recess 36 may be used to connect with a connector in the toy figurine and to act as another mold. The outer surface 30 may have character indicia such as facial characteristics 37 of the fictional character HULK on one portion of the can, shown in FIG. 5, and a brand (logo) 38 on another portion, as shown in FIG. 6. In the alternative, the outer surface 30 may be covered with other facial characteristics, such as the face of the user, or of another Marvel brand hero, such as the stylized facial characteristics of IRON MAN® shown in FIG. 24. In the further alternative, the outer surface of the can may have a design that is a function of the shape or character of a mating toy figurine or some other toy or play item structure. During play, PLAY DOH brand modeling compound product may be resident in the can or the product may be used by the toy user to enhance the play value of the toy figurine as will explained below. If the compound is used for play the can may be partially filled or fully empty of compound product. Whether full, partially filled or empty, the can may still functional as a "head" and "face" (or perhaps a neck, head and face) for the figurine, and as an actuator to manipulate the toy figurine.

Figure 9:
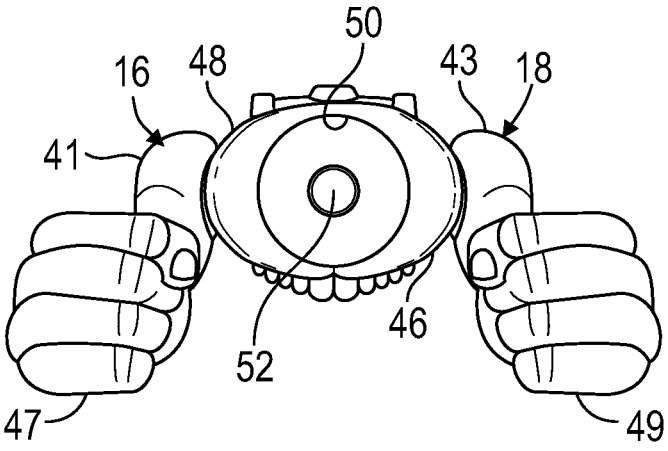
FIG. 9 is a top plan view of the HULK figurine shown in FIGS. 1-4, with the arms in the raised position but with the can removed.
Figure 10:
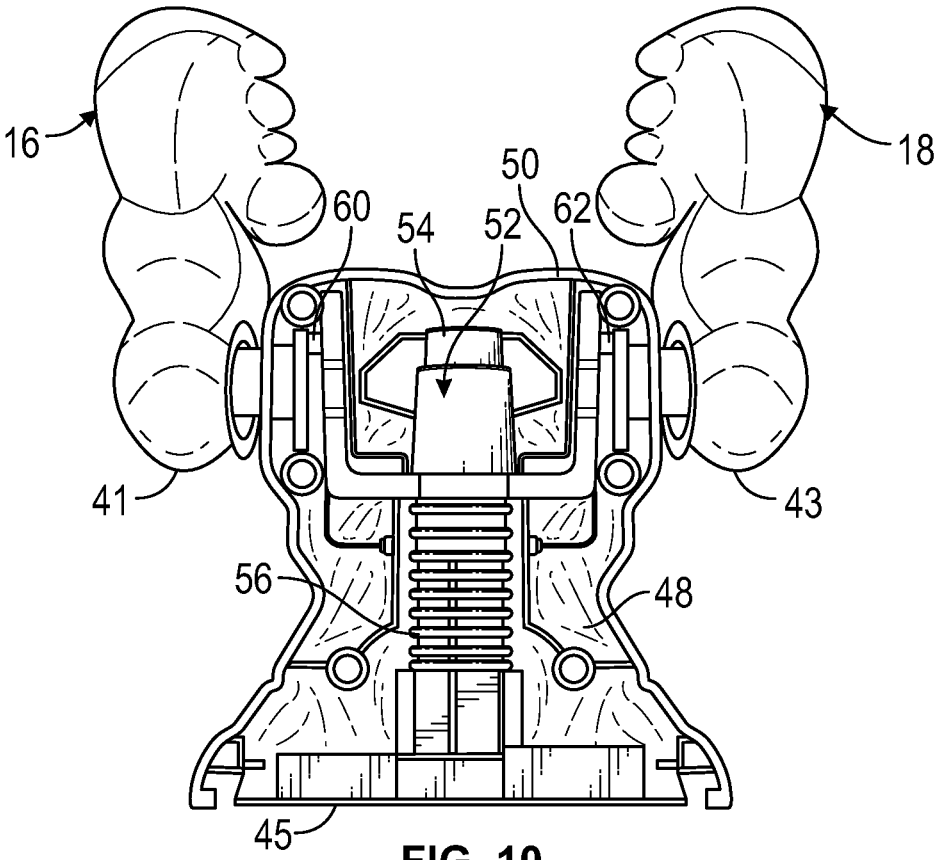
FIG. 10 is a front elevation view of the HULK figurine shown in FIG. 9, with a front portion removed to show an internal mechanism.
Figure 11:
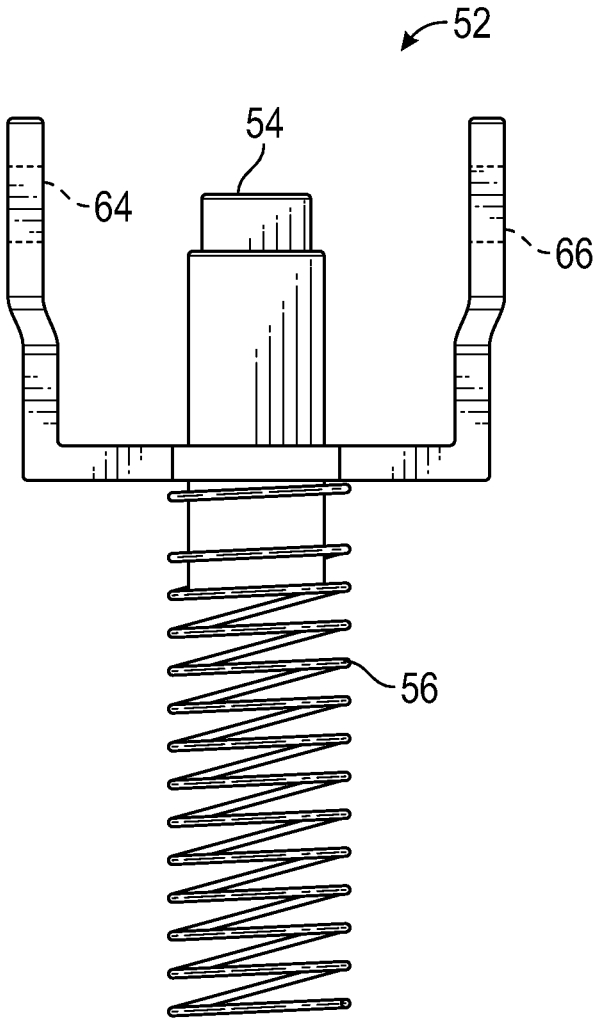
FIG. 11 is a front elevation view of the internal mechanism including a connector and a spring.
Figure 12:
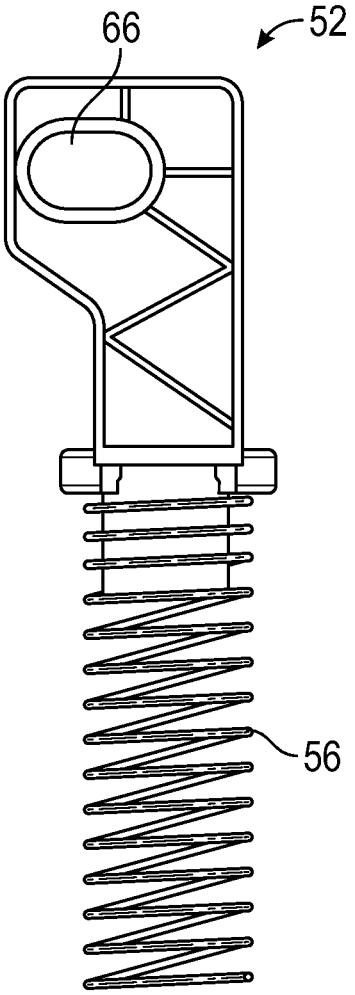
FIG. 12 is a side elevation view of the connector and spring shown in FIG. 11.
Figure 14:
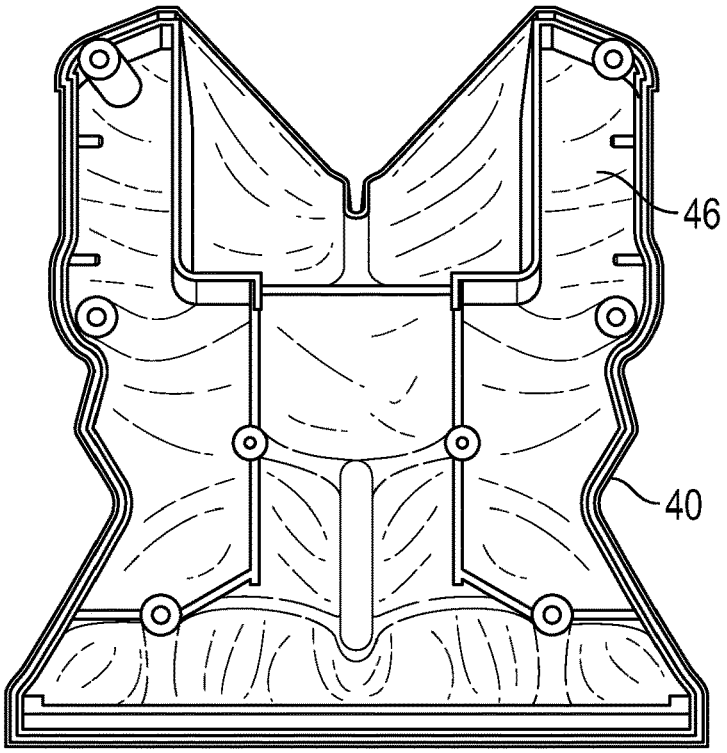
FIG. 14 is an elevation view of the inside of the front portion of the HULK figurine removed from the portion of the HULK figurine shown in FIG. 10.

The stylized HULK figurine 12, FIGS. 1-4, may include, besides the arms 16, 18, a stylized torso 40, oversized feet 42, 44 and a bottom 45 formed beneath the feet 42, 44. The torso includes a front side 46, FIGS. 9 and 14, and a rear side 48, FIGS. 9 and 10. The arms 16, 18 each include a proximal portion or shoulder 41, 43 mounted to the torso 40 and a distal portion or first 47, 49. The inside of the front side 46 of the torso 40 is shown in FIG. 14. At the upper portion of the torso 40 is an opening 50, FIG. 9, for receiving the PLAY DOH can 14 featuring the HULK face on the outer surface 30. As mentioned and shown, the can 14 assumes the location of the head and face of the toy figurine 12. The arms 16, 18 are movable between the first raised position illustrated in FIG. 2, and the second lowered position illustrated in FIG. 4, where the distal portions are generally or about level with the bottom 45.

Figure 13:
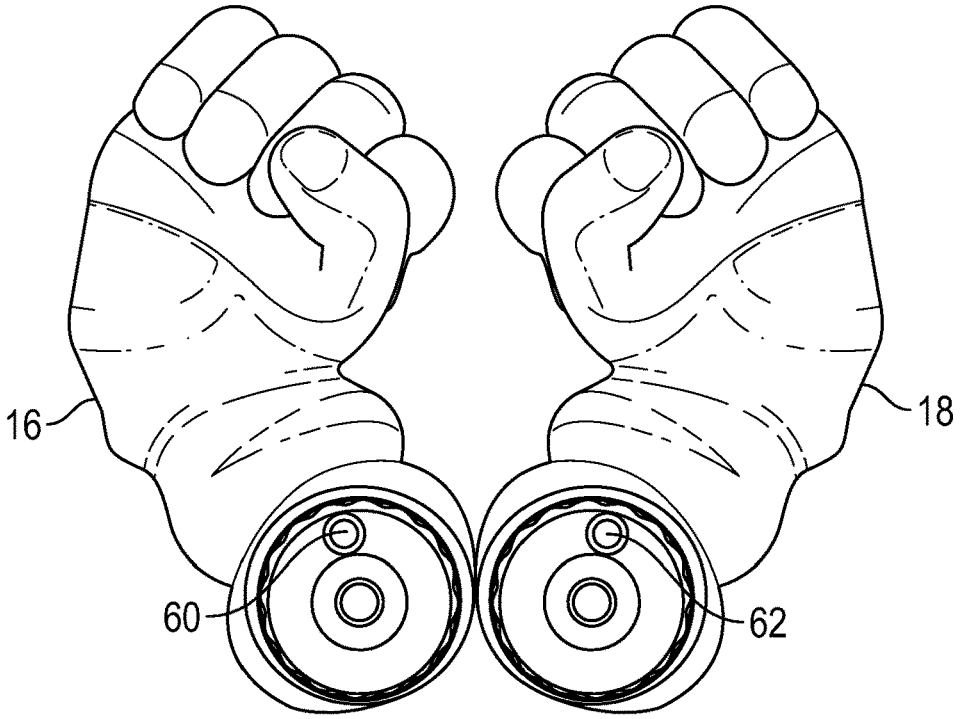
FIG. 13 is a side elevation view of the arms removed from the HULK figurine.

Within the toy figurine 12 is an internal mechanism or linkage including a connector 52, FIGS. 9-12, including a can mounting post 54 biased by a spring 56. When the can 14 is inserted through the opening 50, the recess 36, FIG. 8, of the can mates with the post 54. The connector 52 also receives shafts 60, 62, FIGS. 10 and 13, mounted to the arms 16, 18 which engage in connector slots 64, 66, FIGS. 11 and 12, such that when the connector 52 is pushed downward when the user depresses the can 14, the connector 52 moves downward to compress the spring 56. At the same time the walls surrounding the slots 64, 66 operate as cams to move the shafts 60, 62 that operate as cam followers and thereby cause the arms 16, 18 to rotate from the upper position to the lower position. When the user releases the can 14, FIG. 1, the spring 56 biases the connector upward and the connector slot walls function as cams to move the arms upward to the arms' upper position. Simultaneously, the can returns to the can's first upper position.

Figure 15:
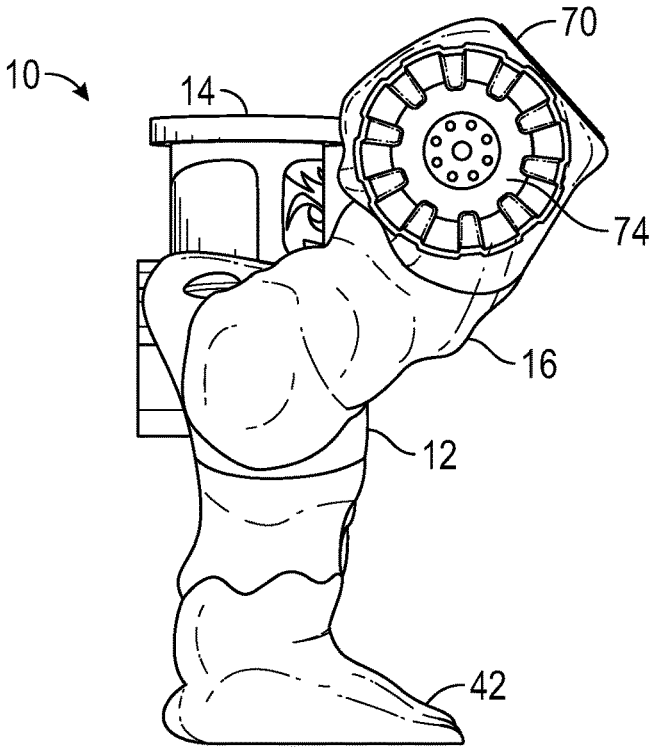
FIG. 15 is a right side elevation view of the toy apparatus shown in FIGS. 1-4, and illustrating the right arm having a mold for a wheel.
Figure 16:
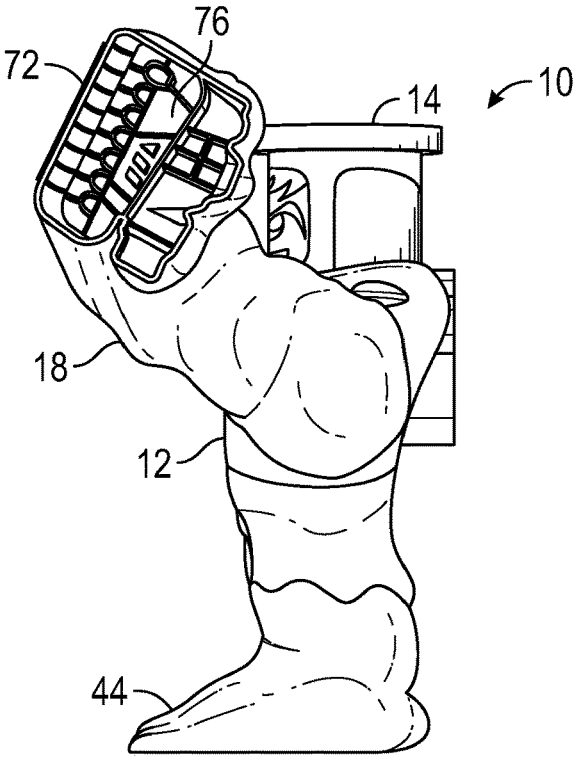
FIG. 16 is a left side elevation view of the toy apparatus shown in FIGS. 1-4 and 15, and illustrating the left arm having a mold for a tank.

Referring now to FIGS. 15-18, the toy action figure figurine 12 includes a multiplicity of features that have play value when combined with the PLAY DOH modeling compound product. For example, the HULK figurine arms 16, 18 may have stamp designs 70, 72, FIG. 1. When a blob of PLAY DOH modeling compound is placed adjacent the feet 42, 44 of the figurine 12, and the arms 16, 18 are rotated by pushing down on the can head 14, the stamp designs 70, 72 will press into the blob and clearly appear in the modeling compound. On the side of the right arm 16, FIG. 15, is a mold 74 of a wheel, while on the side of the left arm 18, FIG. 16, is a mold 76 of a tank. Filling the molds 74, 76 with PLAY DOH modeling compound will form a wheel and a tank from the compound and provide more items for play.

Figure 17:
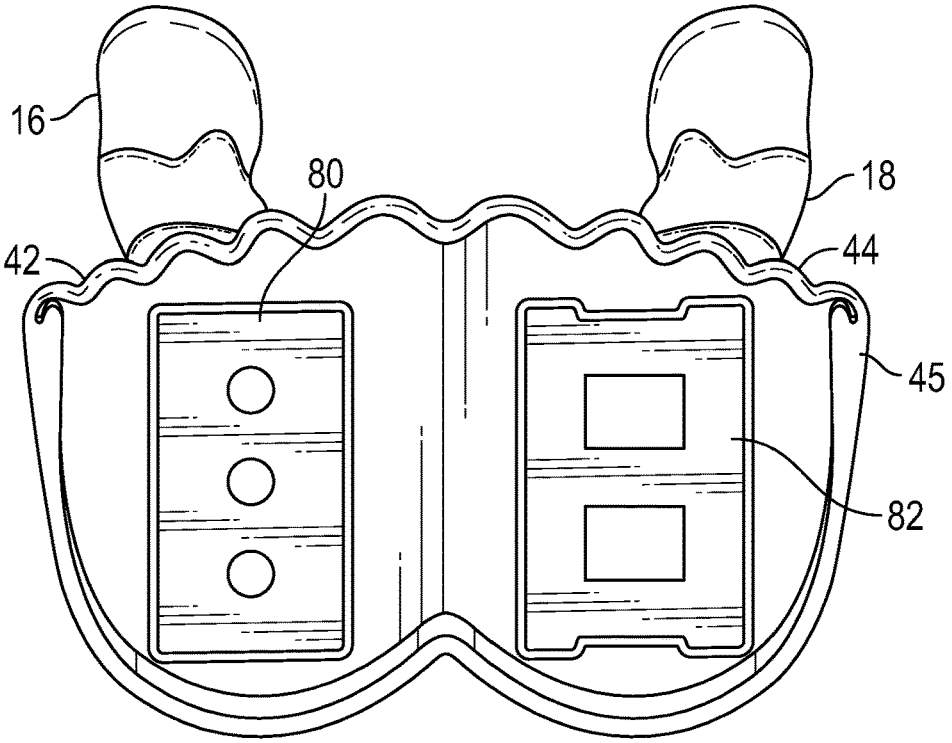
FIG. 17 is a bottom plan view of the toy apparatus shown in FIGS. 1-4, 15 and 16, and illustrating feet having molds for bricks.
Figure 18:
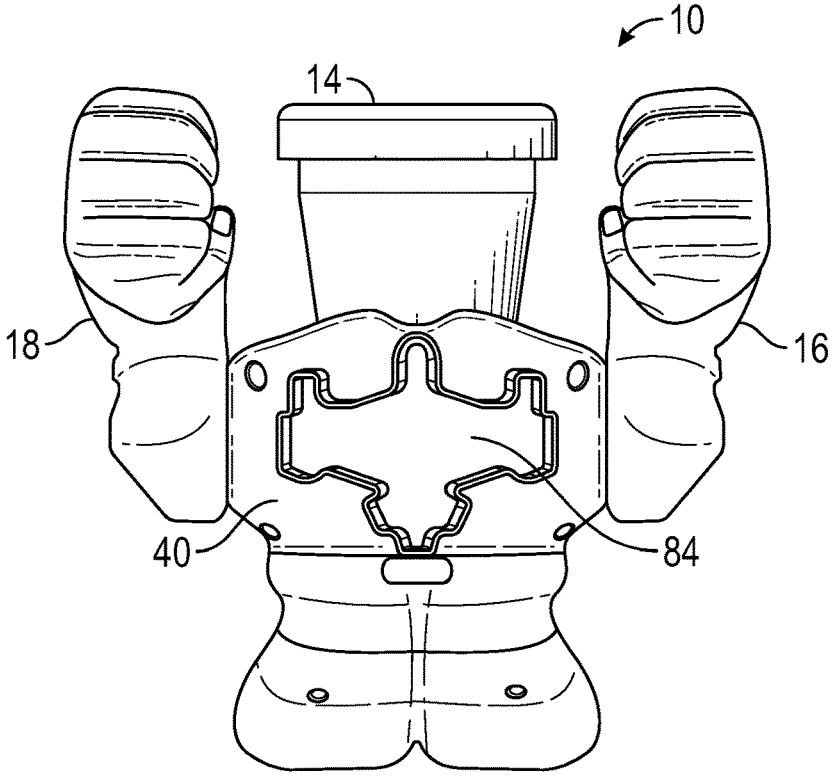
FIG. 18 is a rear elevation view of the toy apparatus shown in FIGS. 1-4 and 15-17, and illustrating a torso back having a mold for an airplane.

In a similar manner, under each of the feet 42, 44, FIG. 17, may be a mold, for example, molds 80, 82 for bricks, and on the rear side 48 of the torso 40, FIG. 18, may be a mold 84 for an aircraft. In the alternative, other mold designs may be formed in the toy figurine. It is well known that the PLAY DOH modeling compound may be reused, and may also be used and reused in other molds independent of the action figures mentioned here.

Figure 23:
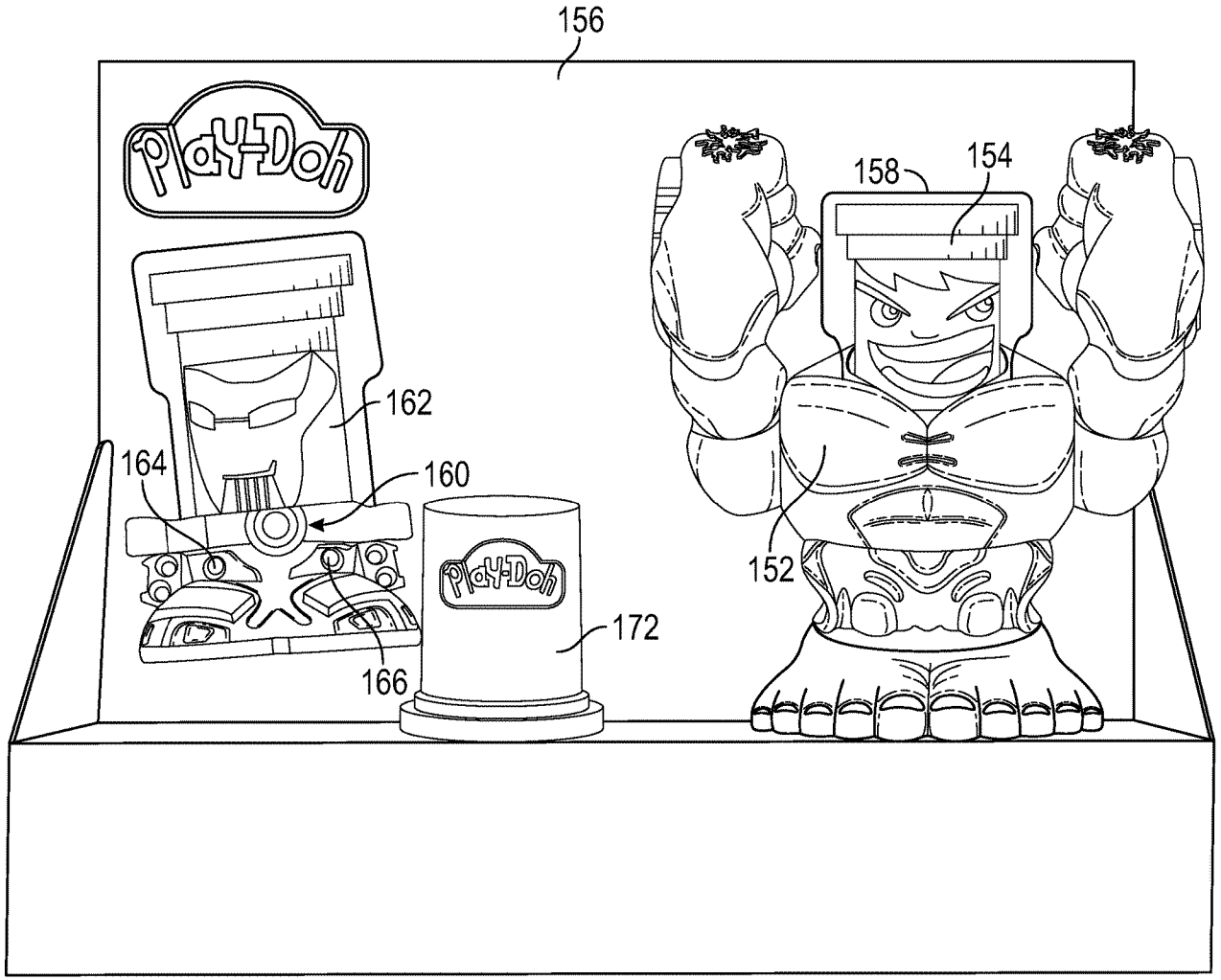
FIG. 23 is a front elevation view of a retail package having the toy apparatus including the can containing PLAY DOH modeling compound mounted to the HULK figurine, a second can containing PLAY DOH modeling compound mounted on a stylized IRON MAN® figurine and a third can containing PLAY DOH modeling compound.
Figure 24:
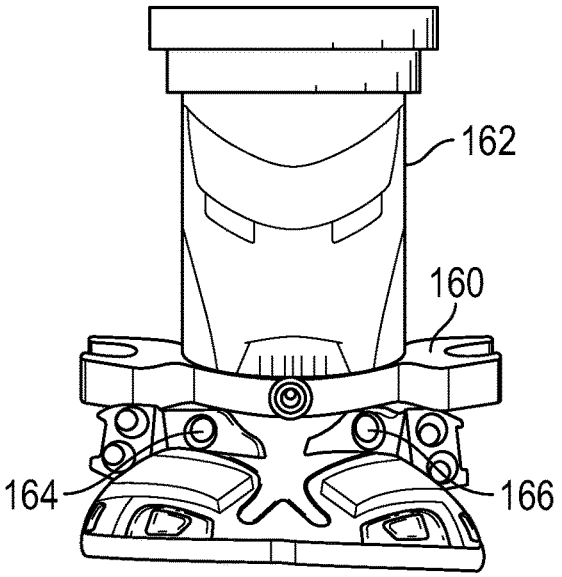
FIG. 24 is a front elevation view of the can of PLAY DOH modeling compound mounted on the IRON MAN figurine shown in FIG. 23.
Figure 25:
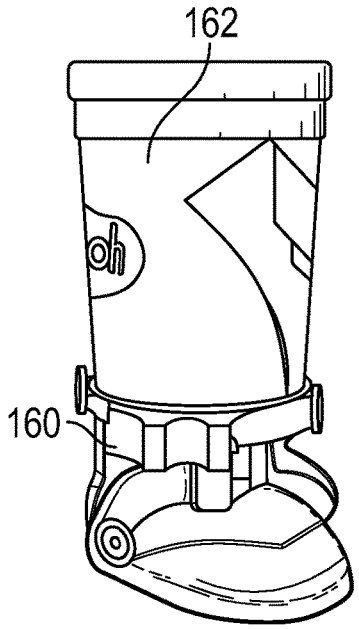
FIG. 25 is a side elevation view of the can of PLAY DOH modeling compound mounted to the IRON MAN figurine shown in FIGS. 23 and 24.
Figure 26:
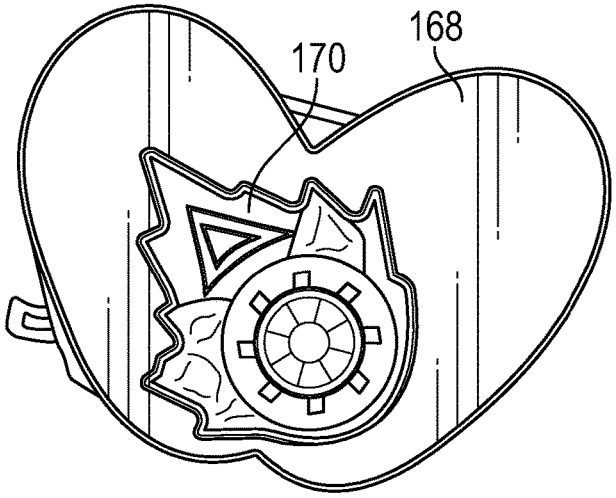
FIG. 26 is a bottom plan view of the IRON MAN figurine shown in FIGS. 23-25, illustrating a mold for a rocket ship.

It may now be appreciated that the combined can and figurine toy apparatus offer many advantages, such as those already mentioned, as well as others. For example to enhance play value, after modeling compound is removed from the head/face can, the can may become a storage compartment. A user may also mix and match cans having different head/face characteristics, including his own, with figurines having different body characteristics thereby creating an endless number of different characters. For another example, while a HULK head/face can is illustrated and described atop a HULK figurine body, the IRON MAN head/face can illustrated in FIG. 23-25, may be mounted to the HULK figurine body and the HULK head/face can may be mounted on an IRON MAN figurine body that is also illustrated in FIGS. 23-25. Each can and each toy figurine are interchangeable so that multiple cans each with a different face/head may be matched with multiple figurine bodies. Such figurine "mash-ups" has no limit except a user's imagination. More examples of alternatives are described below.

Figure 19:
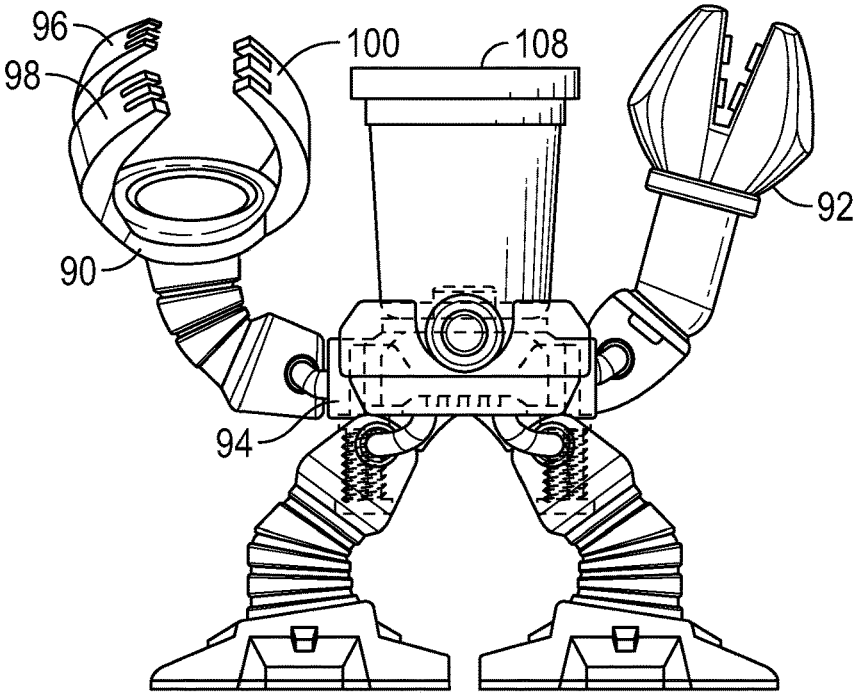
FIG. 19 is a front view of another embodiment of a toy apparatus including a figurine and a can for PLAY DOH modeling compound where the figurine includes a first arm for holding a can for modeling compound and a second arm for grabbing a blob of PLAY DOH modeling compound.
Figure 20:
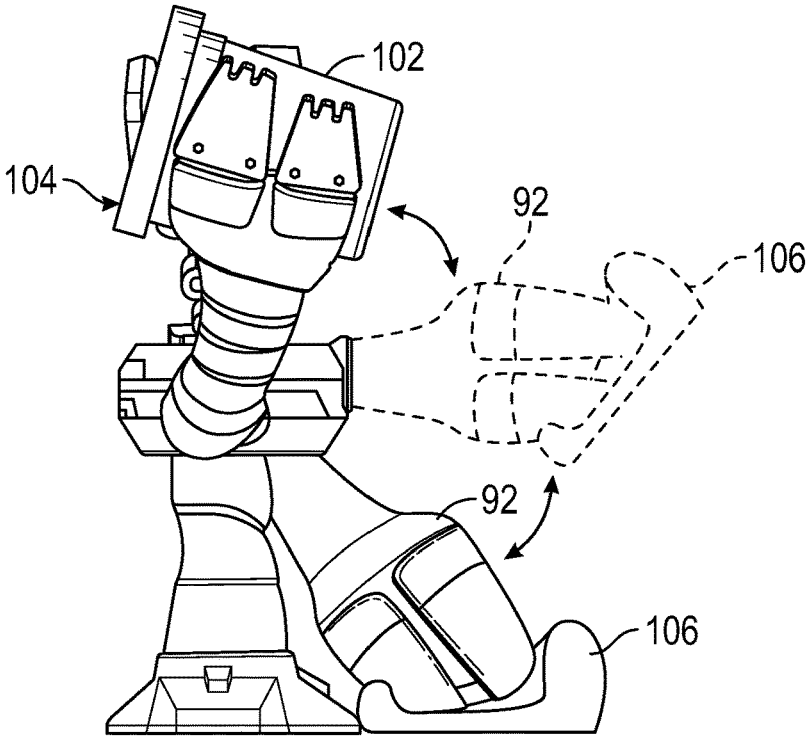
FIG. 20 is a side elevation view of the toy apparatus shown in FIG. 19 with the raised first arm holding a can for PLAY DOH modeling compound and a blob of modeling compound located beneath the second arm, and the blob partially raised, shown in dotted lines.

An alternative set of arms 90, 92 on another toy figurine embodiment 94 are shown in FIGS. 19 and 20. The right arm 90 includes curved fingers 96, 98, 100 for placement around the outer surface 102 of a can 104 to support and move the can. The left arm 92 is designed to cradle an item (not shown) or to smash a PLAY DOH modeling compound blob 106. As with the earlier embodiment, both the blob 106 and the can 104 may move with the respective arm when an actuator can 108 is depressed and released by a user as indicated by the double headed arrow.

Figure 21:
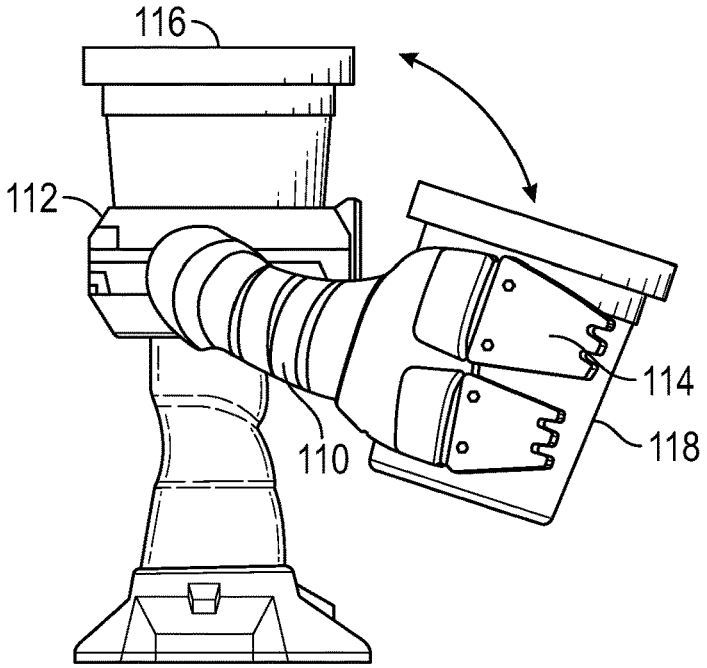
FIG. 21 is a side elevation view of a toy apparatus including a figurine and a can and having another arm embodiment with a claw that opens when a first PLAY DOH can is depressed by a user to allow the claw to grab and raise another PLAY DOH can when the first can is released.

Another alternative arm 110, FIG. 21, on still another toy figurine embodiment 112 illustrates a claw 114 that moves between upper and lower positions when a head can 116 is depressed and released. When the head can is depressed the claw 114 opens and another PLAY DOH can 118 may be grasped. When the head can 116 is released, the claw 114 closes around the can 118 and lifts the can upward as indicated by an arrow.

Figure 22:
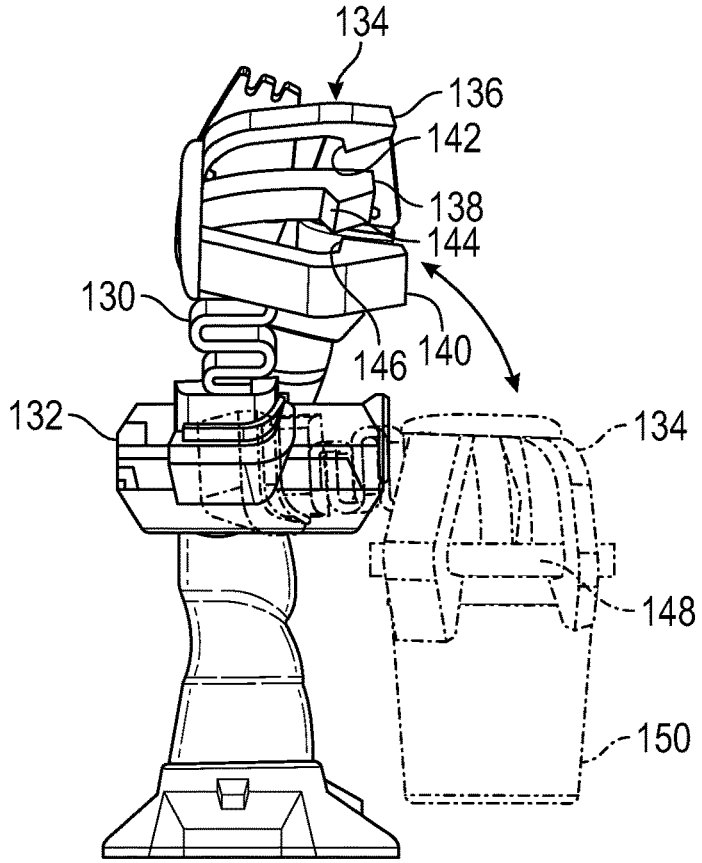
FIG. 22 is a side elevation view of a toy apparatus including a figurine and a can and having yet another arm embodiment having a claw with detents where the claw rotates from a raised position to a lowered position when a first PLAY DOH can (not shown) is depressed allowing the claw to engage and raise a second PLAY DOH can (shown in phantom lines) when the first PLAY DOH can is released.

Still another alternative arm 130, FIG. 22, on yet another toy figurine embodiment 132 includes a claw 134 that moves from an upper to a lower position when a head can (not shown) is depressed and in reverse when the head can is released. The claw 134 includes fingers 136, 138, 140, each with a detent 142, 144, 146. When the arm 130 rotates downward, the detents 142, 144, 146 on the claw 134 are able to engage and lock under a PLAY DOH can cover 148 of a can 150 so that when the head can is released, the rotating arm 130 lifts the can 150 upward.

Referring now to FIGS. 23-26, there is illustrated an example of the manner that a HULK figurine 152 and a PLAY DOH brand modeling compound can 154 may be packaged for retail marketing. The toy figurine 152 and the can 154 may be mounted on a display card 156 and covered with shrink-wrap transparent plastic 158. The HULK figurine 152 and the PLAY DOH can 154 may be combined with the IRON MAN figurine 160 and a second can of PLAY DOH modeling compound 162 arranged as a face and head for the IRON MAN figurine 160.

The IRON MAN figurine 160 may have movable parts or, as illustrated, may not have movable parts. However, the IRON MAN figurine may include front recesses 164, 166 for molds or for receipt of contrasting color modeling compound that decorates the figurine. Like the HULK figurine 152, the IRON MAN figurine 160 may include a bottom surface 168, FIG. 26, with a mold 170 for a rocket ship. A third PLAY DOH can 172 of modeling compound may also be included with the HULK figurine 152, the first PLAY DOH can 154 of modeling compound, the IRON MAN figurine 160 and the second PLAY DOH can 162 of modeling compound.

There may be many more alternatives to the embodiments described in detail above. To illustrate the breath of the invention, instead of the first toy item being the HULK or IRON MAN toy figurine, the toy or play item may be a vehicle or other toy model with a movable part. Also in the alternative, instead of the can for modeling compound being depressed by a user so as to move up and down to actuate the toy item, the hexagon shaped recess 36 in the bottom of the can may engage a mating hexagon or other shaped mounting post in a toy item to allow the can to be twisted by a user to cause movement of a part of the toy item. For example, the can 14 may have the head of a STAR WARS® brand pilot mounted in a STAR WARS brand X-WING® fighter where the wings open when the can is twisted instead of being depressed, or the can may move sideways in a slot to cause a part in the toy item to move. Or, instead of a pilot the can may have an outer surface depicting R2D2® mounted in the X-WING fighter. Still another alternative may have a can with a "character" outer surface mounted on a toy item that also includes a catapult. Depressing, twisting or sliding the can may operate the catapult to hurl a blob of modeling compound. Yet another alternative may involve a land vehicle where movement of the can may cause movement of the vehicle. A still further alternative, a user's movement of the can may actuate a missile launch from any kind of flying or land vehicle toy item.

It is noted that throughout this description, words such as "front" and "rear," and "upper" and "lower" as well as similar positional or locational terms, refer to portions or elements of the toy apparatus as they are viewed in the drawings relative to other portions, or in relationship to the positions of the apparatus as it will typically be held and moved during play by a user, or to movements of elements based on the configurations illustrated.

In operation, the user of the toy apparatus 10 mounts the can 14 for PLAY DOH modeling compound through the opening 50 at the top of the figurine's torso 40. The can is mounted to move up and down or between upper and lower positions relative to the figurine when moved downward by the user and upward by the biasing spring 56. The can includes facial characteristics on its outer surface so as to appear when mounted on the toy figurine as the face and head of the figurine. The toy figurine 12 is constructed with rotatable arms that are operable by the user when he/she depresses the top of the can. To enhance play value the figurine may have stamp designs and mold recesses so that the PLAY DOH modeling compound product may be used outside of the can for molding additional play items or for being embossed by the stamps. The bottom wall of the can may also have a recess to facilitate mounting of the can on the figurine and/or to act as a mold for the modeling compound.

Figure 27:
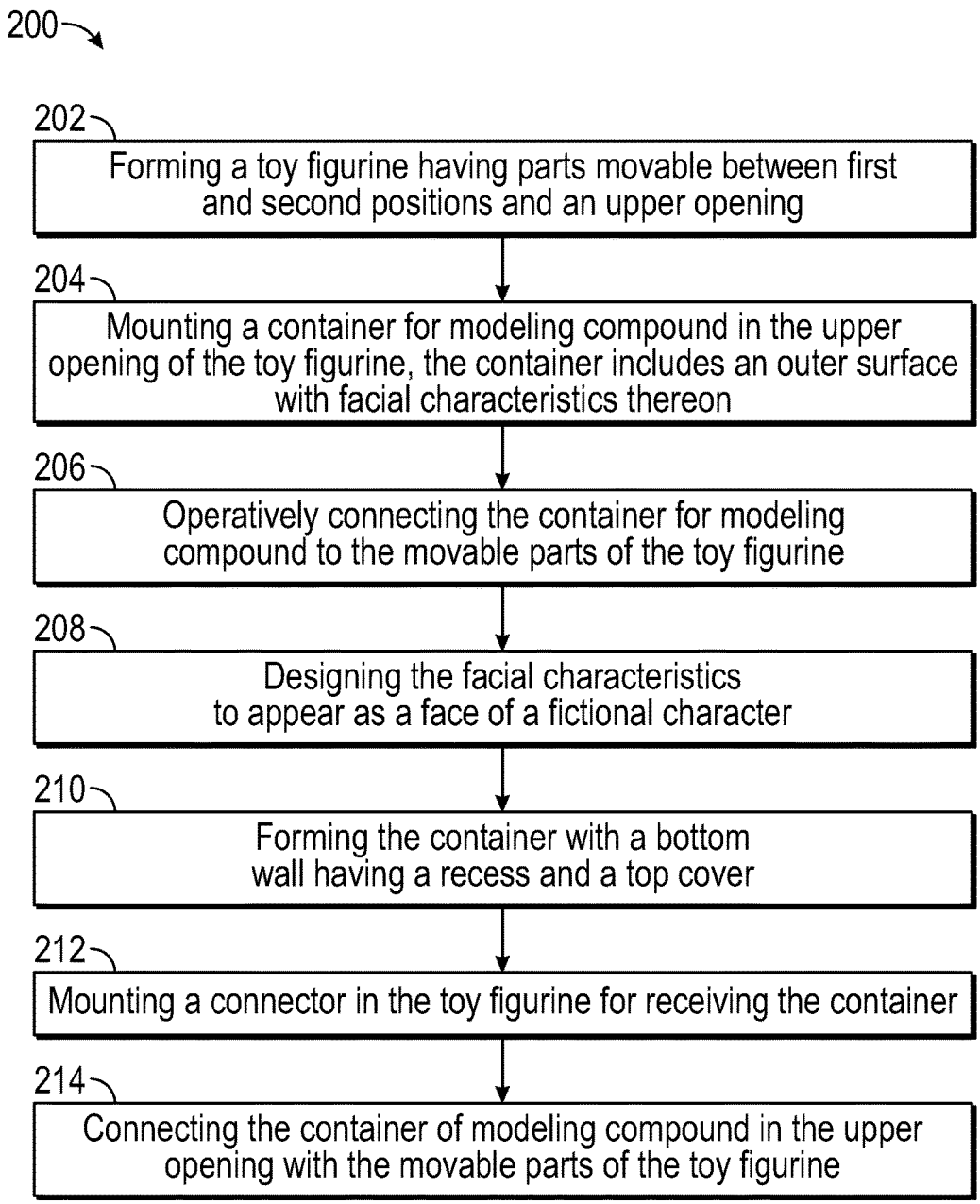
FIG. 27 is a flow diagram of a method for making a toy apparatus including the combination of a toy item, and a container for modeling compound.

The present invention also includes a method 200, FIG. 27, for making a toy apparatus, the steps of the method including forming a toy item having parts movable between first and second positions 202, and the toy item having an upper opening, mounting a container for modeling compound in the upper opening of the toy item 204, the container for modeling compound being movable between upper and lower positions, wherein the container includes an outer surface with facial characteristics thereon, and operatively connecting the container for modeling compound to the movable parts of the toy item 206 to enable movement of the container for modeling compound by a user from the upper position to the lower position to result in the movable parts of the toy item moving from the first position to the second position.

The method may also include the steps of designing the facial characteristics to appear as a face of a fictional character 208, forming the container with a bottom wall having a recess 210, mounting a connector in the toy item for receiving the container 212 and connecting the container of modeling compound in the upper opening with the movable parts of the toy item 214.

The toy apparatus disclosed in detail above have great play value, are fun to use and easy to operate, and are safe, even for young children, and yet the toy apparatus have robust, but simple structures, that may be produced at reasonable cost.

From the foregoing, it can be seen that there has been provided features for an improved toy apparatus and a disclosure of a method for making the toy apparatus. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims as mandated by the United States Code, Title 35, Section 112, when viewed in their proper perspective based on the prior art.

What is claimed is:

1. A toy apparatus comprising:

a toy item having an upper portion, a bottom and front and back sides;

a container for modeling compound mounted to the upper portion of the toy item, the container being movable by a toy apparatus user between a first position and a second position in relation to the toy item with a plurality of stamp designs on the toy item for engaging modeling compound;

two rotatable appendages, each appendage having a proximal portion and a distal portion, the proximal portion being connected to the upper portion of the toy item and the appendages being movable between a raised position and a lowered position as said container moves between the container's first position and the container's second position in relation to the toy item, wherein in the lowered second position of the appendages the distal portions of the appendages including the stamp design for embossing the modeling compound are located at about the same level as the bottom of the toy item, wherein:

the upper portion of the toy item is in the form of a torso;

the bottom is formed by feet;

the appendages are formed by arms, the arms having proximal shoulders and distal hands; and including a shaft functioning as a cam follower connected to each proximal shoulder;

a connector located within the torso and having two slots, each slot for receiving one of the shafts, the connector functioning a cam; and a spring for biasing the connector upward.

2. The toy apparatus of claim 1, wherein:

each of the arms includes recesses for receiving modeling compound.

3. The toy apparatus of claim 1, wherein:

the arms include stamp designs for imprinting modeling compound.

4. The toy apparatus of claim 1, wherein:

the torso and feet include recesses for receiving modeling compound.

5. The toy apparatus of claim 1, wherein:

the container for modeling compound includes a bottom wall with a recess and a top cover.

6. The toy apparatus of claim 1, wherein:

each distal portion of the appendages includes a stamp design.

7. The toy apparatus of claim 6, including:

modeling compound for engagement by the stamp designs.

8. The toy apparatus of claim 1, wherein:

when moving the two appendages from the raised position to the lowered position the distal portion of the appendages pivot outward from the front side of the toy item.

9. The toy apparatus of claim 1, wherein:

the cam connector includes a central post and two spaced apart elements each of the elements including one of the two slots.

* * * * *